US009963320B2

(12) United States Patent
Couchey et al.

(10) Patent No.: US 9,963,320 B2
(45) Date of Patent: May 8, 2018

(54) SELF-ADJUSTING MOUNTING PLATE FOR WOUND ROLL

(71) Applicant: Sonoco Development, Inc., Hartsville, SC (US)

(72) Inventors: Brian P. Couchey, Inman, SC (US); Chad Eric Lagace, Cohoes, NY (US)

(73) Assignee: Sonoco Development, Inc., Hartsville, SC (US)

( * ) Notice: Subject to any disclaimer, the term of this patent is extended or adjusted under 35 U.S.C. 154(b) by 350 days.

(21) Appl. No.: 14/948,440

(22) Filed: Nov. 23, 2015

(65) Prior Publication Data

US 2017/0144857 A1 May 25, 2017

(51) Int. Cl.

| | |
|---|---|
| ***B65H 75/18*** | (2006.01) |
| ***B65H 16/06*** | (2006.01) |
| ***B65H 19/30*** | (2006.01) |
| ***B65H 18/28*** | (2006.01) |

(52) U.S. Cl.

CPC ..... *B65H 75/185* (2013.01); *B65H 16/06* (2013.01); *B65H 18/28* (2013.01); *B65H 19/30* (2013.01); *B65H 2301/4174* (2013.01)

(58) Field of Classification Search

CPC ..... B65H 16/06; B65H 75/185; B65H 2701/5122; B65D 59/02; B65D 59/08; B65D 85/66; B65D 85/672

USPC ..... 242/423–423.2

See application file for complete search history.

(56) References Cited

U.S. PATENT DOCUMENTS

| | | | | |
|---|---|---|---|---|
| 3,260,362 | A | 7/1966 | Schwinne | |
| 4,034,933 | A | 7/1977 | Hara et al. | |
| 4,877,133 | A | 10/1989 | Klenter et al. | |
| 5,431,282 | A | 7/1995 | Kremp et al. | |
| 5,829,592 | A | 11/1998 | Henry, Jr. et al. | |
| 6,994,291 | B2 | 2/2006 | Kemp et al. | |
| 8,579,224 | B2 * | 11/2013 | Allwood | B65H 49/32 242/423 |
| 2003/0201542 | A1 | 10/2003 | Wu | |
| 2007/0246153 | A1 * | 10/2007 | Schurman | B29C 63/10 156/185 |

FOREIGN PATENT DOCUMENTS

JP 2007090707 A 4/2007

OTHER PUBLICATIONS

International Search Report and Written Opinion for related International Application No. PCT/US16/60985; report dated Feb. 27, 2017.

* cited by examiner

*Primary Examiner* — William E Dondero

(74) *Attorney, Agent, or Firm* — Miller, Matthias & Hull LLP

(57) ABSTRACT

A mounting plate for holding a roll of wound material. The mounting plate comprises a body, a hub extending from the body for holding a core, and one or more spacers affixed to the body and extending beyond the body in the direction of the roll. Each spacer comprises an inner member which may contact the roll and one or more resiliently deformable legs extending outwardly from the inner member. The spacers can maintain contact with the ends of the roll and prevent the roll from being damaged due to telescoping or impacts with the mounting plates or other structures.

15 Claims, 4 Drawing Sheets

SELF-ADJUSTING MOUNTING PLATE FOR WOUND ROLL

BACKGROUND OF THE INVENTION

Field of the Invention

This disclosure relates to a mounting plate for holding a wound roll. More particularly, this disclosure relates to a mounting plate having built-in spring-like elements that stabilize the roll to prevent damage to the roll.

Description of the Related Art

Window film and other web-like materials may be wound and then carried on a cylindrical core for shipping and handling. The core may be mounted between two mounting plates (also referred to as pad plugs, end plates, end caps, end walls or end boards). Part of the core may extend beyond each end of the wound material, resulting in a gap between the wound material and the mounting plates. This gap can cause the wound material to slide or telescope between the mounting plates and become damaged.

In order to fill this gap, cardboard spacers may be inserted between the web and the mounting plates, but this solution results in contamination and additional cost and labor. The present disclosure addresses these problems by providing a self-adjusting mounting plate, one that takes up the gap between the mounting plate and the wound roll.

BRIEF SUMMARY OF THE INVENTION

The present disclosure relates to a mounting plate for holding a roll consisting of a core around which is wound a web of material. The mounting plate comprises a body, a hub extending from the body and one or more spacers affixed to the body and extending beyond the body in the direction of the wound roll. Each spacer comprises an inner member which may contact the wound roll and a plurality of legs extending outwardly from the inner member away from the wound roll. The legs are resiliently deformable between a first position in which the legs are uncompressed and the inner member is at an innermost position (in the direction of the wound roll) and a second position in which the legs are compressed and the inner member is located outwardly (in the direction away from the wound roll). The spacers can maintain contact with the ends of the wound roll and prevent the wound roll from being damaged due to telescoping or impacts with the mounting plates or other structures.

DETAILED DESCRIPTION OF THE INVENTION

Figure 1:
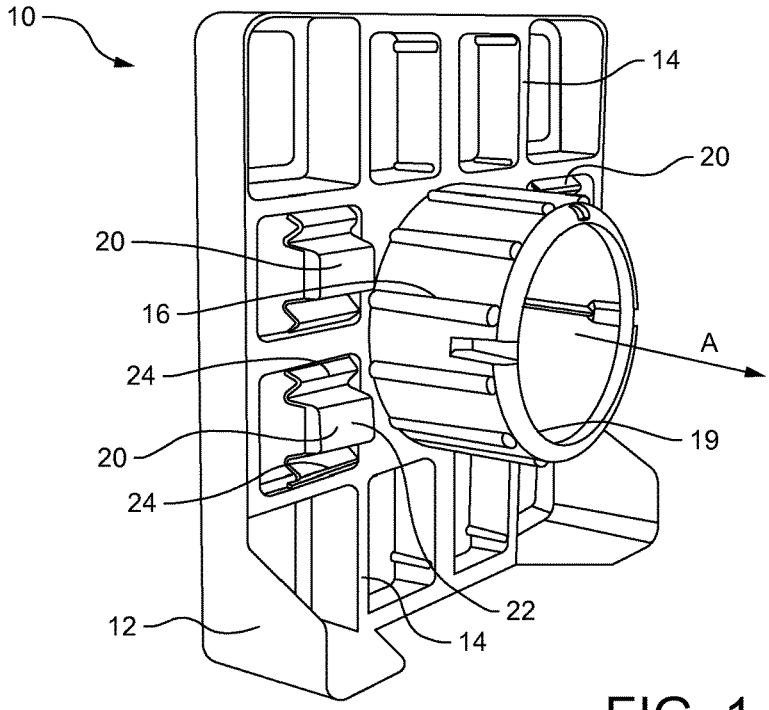
FIG. 1 is perspective view of a mounting plate according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments.

In the discussion that follows, the terms "inward", "inwardly" and "innermost" mean in the direction of a roll of wound material that may be held on the mounting plate and the terms "outward" or "outwardly" refer to the direction away from the roll of wound material. For example, in FIG. 1 "inwardly" refers to the direction indicated by arrow A. The terms "web", "wound material", "wound roll" and "roll of wound material" generally are synonymous, and refer to the material that is wound around a core.

Turning to the drawings, there is shown in FIG. 1 one embodiment of the present invention, a mounting plate 10 for holding a roll of wound material (not shown). The roll of wound material is carried on a cylindrical core which may stick out from either end of the wound roll. The mounting plate 10 comprises a body 12 having a generally flat inner (roll facing) surface 14 that defines an inner plane (similar to inner plane (P) in FIGS. 4 and 6) and a hub 16 extending inwardly from the body 12 in the direction of the roll and terminating in a rim 19. The hub 16 is substantially cylindrical and defines a hub axis (A). The body 12 may be made of a molded thermoplastic material and may be generally rectangular as shown in the figures or any suitable shape.

The outer diameter of the hub 16 may be slightly less than the inner diameter of the core. During use, the cylindrical core (not shown) fits around the hubs 16 of two opposing mounting plates 10 and is suspended therebetween. The ends of the wound roll face the mounting plates 10. With conventional mounting plates there can be a gap between the roll of wound material and the mounting plates. This gap can cause the wound roll to slide or "telescope" back and forth between the mounting plates and become damaged.

To solve this problem, the mounting plate 10 further comprises one or more spring-like spacers 20 to occupy the gap between the roll and the mounting plate 10. The spacers 20 may be affixed to the body 12 and extend outwardly beyond the inner plane in the direction of the roll, but not beyond the hub rim. The spacers 20 may be made of a resilient material such as plastic or have a resiliently deformable structure.

Each spacer 20 comprises an inner member 22 which may contact the roll and a plurality of legs 24 extending outwardly from the inner member 22 away from the roll. Three spacers 20 are shown in FIG. 1; although it may be assumed that a fourth spacer 20 is obscured by the hub 16. The mounting plate 10 may comprise any suitable number of spacers 20.

As explained more fully below, the inner member 22 can move axially and reciprocally, that is, back and forth in the direction of hub axis A. In this way the spacers 20 can maintain contact with the ends of the roll and prevent the roll from being damaged due to telescoping or impacts with the mounting plates 10 or other structures.

Figure 2:
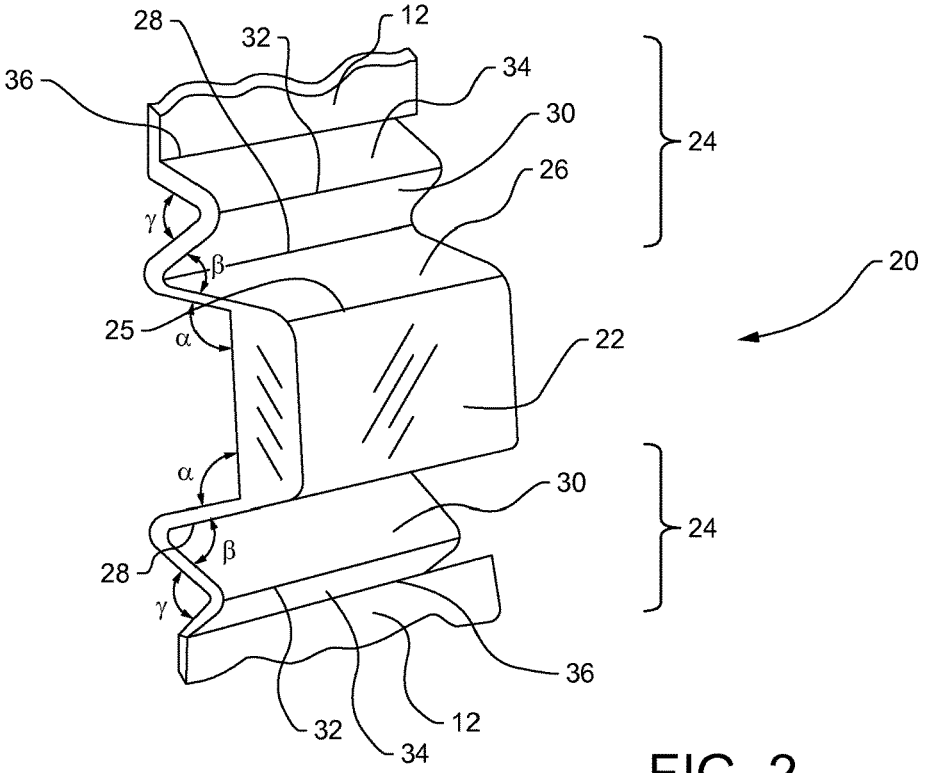
FIG. 2 is a close up perspective view of a portion of the mounting plate of FIG. 1.

FIG. 2 is a close up of a portion of the mounting plate of FIG. 1 showing a spacer 20 in more detail. The legs 24 are resiliently deformable between a first position in which the legs 24 are relaxed (not compressed) and the inner member 22 is at its innermost position, and a second position in which the legs 24 are compressed and the inner member 22 is located outwardly from its innermost position.

Each leg 24 may comprise a first panel 26, a second panel 30 and a third panel 34 arranged in a zig zag or accordion shape to provide a double hinged, spring-like structure. The first panel 26 may extend outwardly from the inner member 22 at an oblique angle (α) and away from the other first panel 26. The first panel 26 may terminate along a first hinge line 28. The second panel 30 may extend inwardly (in the direction of the inner member 22) at an acute included angle (β) from the first hinge line 28 and may terminate along a second hinge line 32. The third panel 34 may extend outwardly at an angle (γ) from the second hinge line 32 and may terminate at the body 12. The third panel 34 may be joined or otherwise affixed to the body 12 along a third line 36. The third line 36 may be a rigid connection line or may be a third hinge line.

The first hinge line 28 may be located inward from the third line 36, outward from the third line 36, or may lie along the same plane as the third line 36.

The second hinge line 32 is located inward from the first hinge line 28 and inward from the third line 36.

If a compressive force, such as from the end of a wound roll, acts on the inner member 22, each leg 24 will bend along one or both hinge lines. The inner member 22 will move outwardly, in the direction toward the mounting plate body 12. The first, second and third panels 26, 30, 34 may move toward each other. The angles α, β, γ formed by the panels 26, 30, 34 may become smaller.

It should be understood that other configurations are contemplated and fall within the scope of the disclosure. For example, each spacer leg may simply comprise a first panel that extends outwardly from the inner member 22 at an oblique angle (α) and is made of a resiliently deformable material that enables the inner member 22 to move outwardly in response to a force applied by a roll. In another example, the each spacer leg may comprise a first outwardly extending panel 26 connected to a second inwardly extending panel 30, wherein the second panel 30 is attached to the body 12 along a hinge line.

Figure 3:
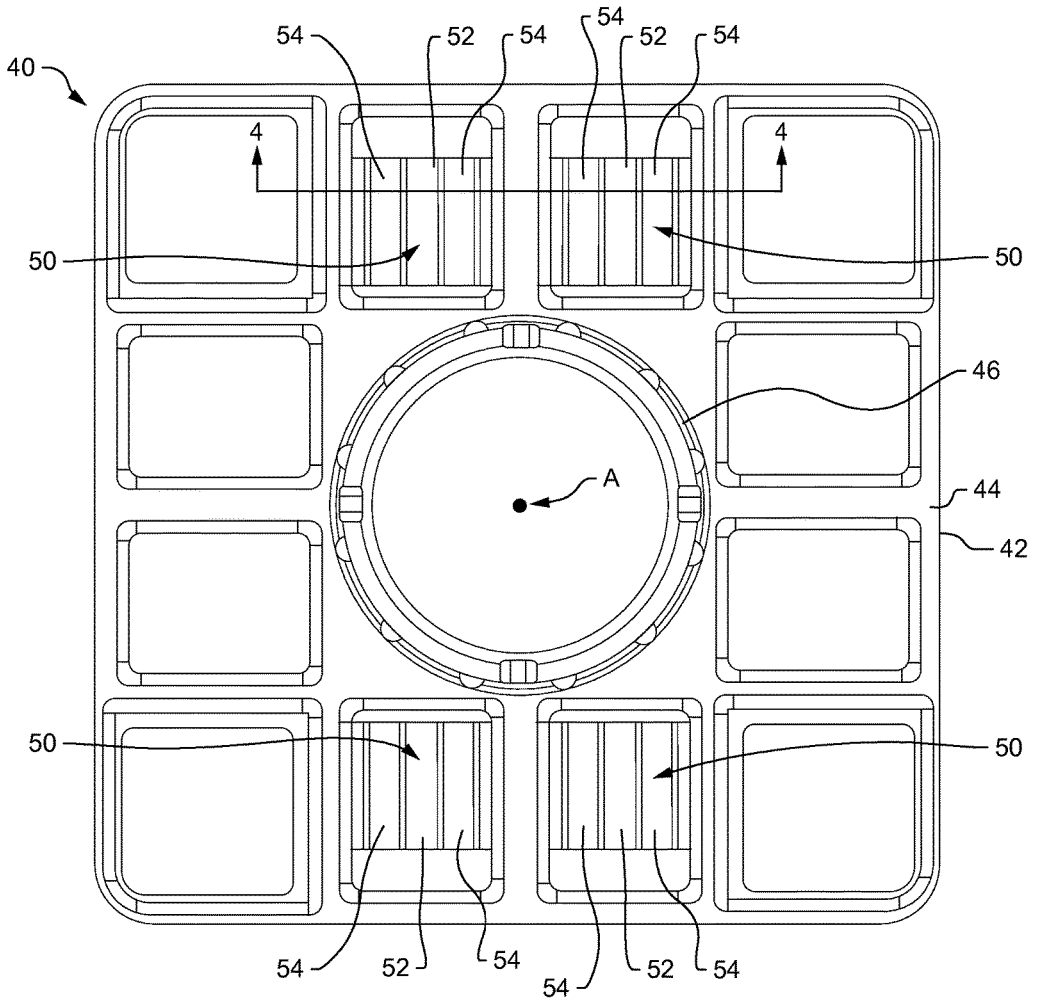
FIG. 3 is a front plan view of a second embodiment of a mounting plate according to the disclosure.

FIG. 3 is a front plan view of a second embodiment of a mounting plate according to the disclosure. As in the previous embodiment, the mounting plate 40 may comprise a body 42 having a wound roll or web facing surface 44 that defines an inner plane (P) and a core hub 46 extending from the body 42 in the direction of the roll. The core hub 46 is substantially cylindrical and defines a hub axis A, which in FIG. 3 is normal to the plane of the paper.

Spring-like spacers 50 are fitted onto or incorporated integrally into the body 42 and extend inwardly beyond the inner plane (P) of the body 42 (toward the reader in FIG. 3). Each spacer 50 comprises an inner member 52 which may contact a roll carried on the hub 46 and a pair of legs 54 generally extending outwardly from the inner member 52 (away from the reader in FIG. 3) and affixed to the body 12. Each inner member 52 can move reciprocally and axially back and forth with spring-like support in the direction of the axis A. Four spacers 50 are shown in FIG. 3, although as in all embodiments described herein, including this one, any suitable number of spacers 50 may be used.

Figure 4:
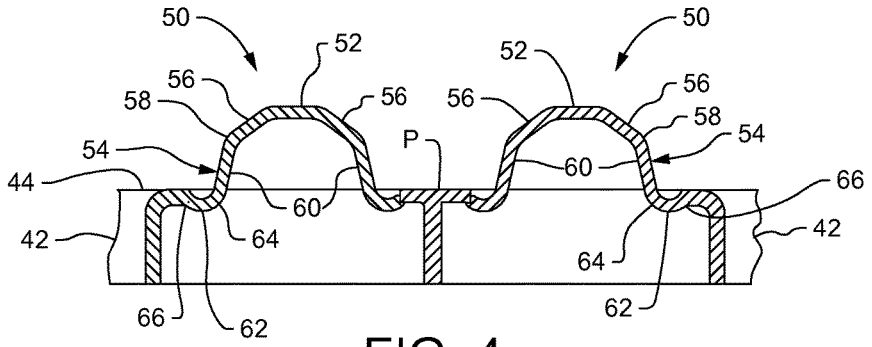
FIG. 4 is a cross-sectional view of the mounting plate of FIG. 3 taken along line 4-4.

FIG. 4 is a cross-sectional view of the mounting plate 10 of FIG. 3 taken along line 4-4. Each leg 54 may form roughly an "S" cross-sectional shape and comprises a first section 56, a second section 60 and a third section 62. The first section 56 may be flat or curved and may extend outwardly from the inner member 52 to a first inflection line 58. The second section 60 may be flat or curved and may extend outwardly from the first inflection line 58 and may terminate at a second inflection line 64. The third section 62 may extend from the second inflection line 64 and connect to the body 42 along a hinge line 66. The third section 62 may be curved and may form a "U" shape. All or part of the third section 62 may be located below the inner plane (P) of the body 42.

If a compressive force, such as from the end of a wound roll, acts on the inner member 52, each leg 54 will deform (change shape). The inner member 52 will move outwardly, in the direction toward the mounting plate body 42.

Figure 5:
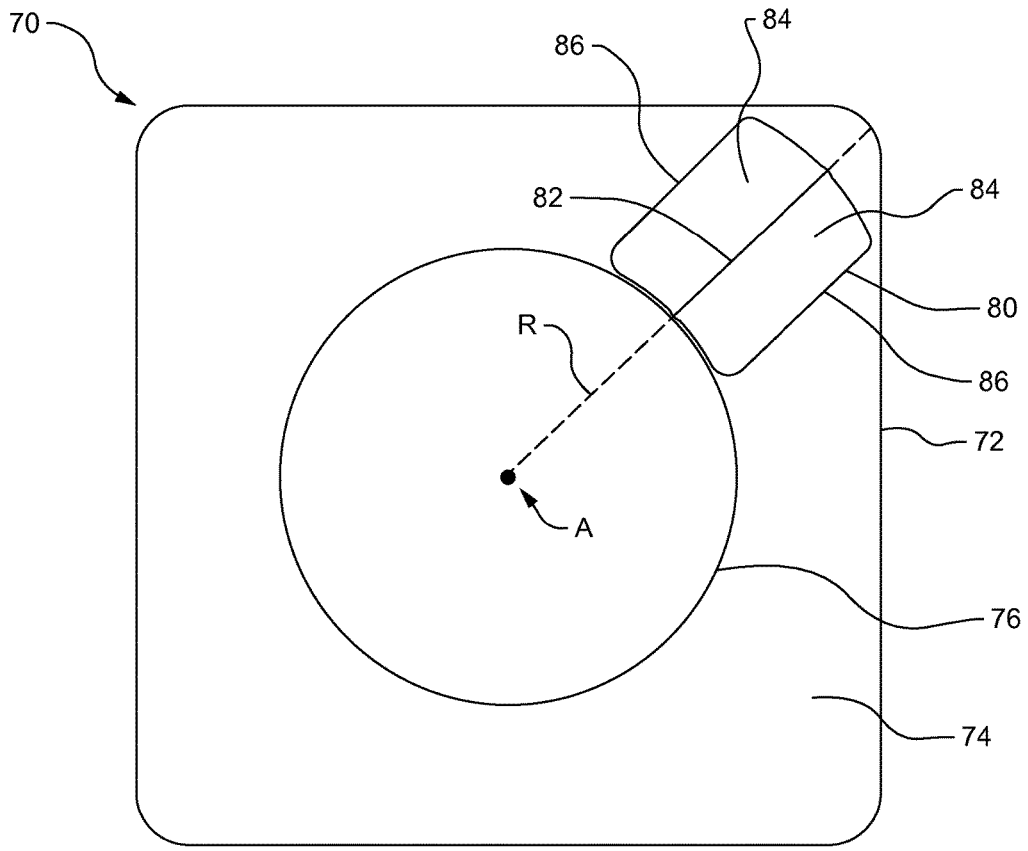
FIG. 5 is a front plan view of a third embodiment of a mounting plate according to the disclosure.

FIG. 5 is a front plan view of a third embodiment of a mounting plate 70 according to the disclosure. As in the previous embodiments, the mounting plate 70 may comprise a body 72 having a web facing surface 74 that defines an inner plane and a hub 76 extending inwardly from the body 72. The hub 76 is substantially cylindrical and defines a hub axis A, which in FIG. 5 is normal to the plane of the paper.

One or more spring-like spacers 80 are affixed to or integrally formed with the body 72 and extend inwardly beyond the inner plane. Only one spacer 80 is shown in FIG. 5. The spacer 80 is arcuate shaped when viewed in a cross-section taken along a plane normal to the radial line (R), and comprises two curved legs 84 extending outwardly (away from the reader in FIG. 5) from either side of a center apex 82 to the body 12. Each leg 84 may be joined to the body 72 along a line 86 that may or may not form a hinge.

If a compressive force, such as from an end of a wound roll, acts on the inner member spacer 80, the spacer 80 will deform and the apex 82 will move outwardly, in the direction toward the mounting plate body 72.

Figure 6:
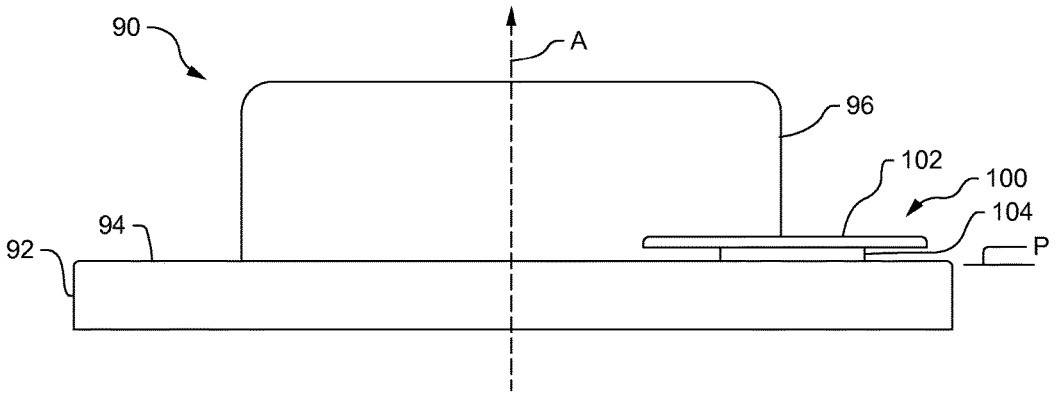
FIG. 6 is a side view of a fourth embodiment of a mounting plate according to the disclosure.

FIG. 6 is a side view of a fourth embodiment of a mounting plate 90 according to the disclosure. Once again the mounting plate 90 may comprise a body 92 having a web facing surface 94 that defines an inner plane (P) and a hub 96 extending inwardly from the body 92 in the direction of the roll or web. The hub 96 is substantially cylindrical and defines a hub axis (A). One or more spacers 100 are fitted onto or incorporated into the body 92 and extend beyond the inner plane (P). Only one spacer 100 is shown in FIG. 6.

Figure 7:
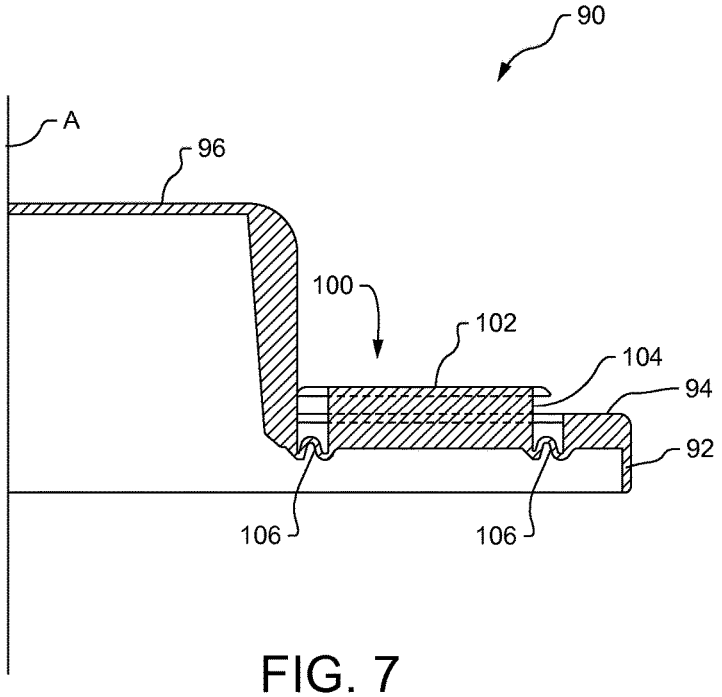
FIG. 7 is a cross-sectional view of the right half of the mounting plate of FIG. 6.

FIG. 7 is a cross-sectional view of the right half of the mounting plate of FIG. 6 showing the spacer 100 in more detail. The spacer 100 comprises an inner member 102 mounted on one or more legs 104. The legs 104 are affixed to the body 92 by convoluted bridges 106. The bridges 106 are resiliently deformable between a first position in which the spacer 100 is relaxed (not compressed) and the inner member 102 is at the innermost position shown in the FIG. 7, and a second position in which the spacer 100 is compressed and the inner member 102 is located outwardly from its innermost position, closer to the web facing surface 94 of the mounting plate 90. If a compressive force, such as from an end of a wound roll, acts on the inner member 102, the bridges 106 will deform. The inner member 102 will move outwardly, in the direction toward the mounting plate body 92.

INDUSTRIAL APPLICABILITY

A pair of mounting plates according to the disclosure can be used to hold a core carrying a roll of wound material. The wound material may be any suitable wound material, including paper and plastic films. The spacers fill the gaps between the mounting plate and the wound roll, stabilizing the wound roll and preventing damage to the ends of the wound roll.

The mounting plates can also be used for packaging cores carrying wound rolls. The mounting plates can fill any gaps that might otherwise exist between the wound rolls and the sides of the cardboard package in which the cores typically are shipped.

It should be understood that the embodiments of the mounting plate described above are only particular examples which serve to illustrate the principles of the mounting plate. Modifications and alternative embodiments of the mounting plate are contemplated which do not depart from the scope of the invention as defined by the foregoing teachings and appended claims. It is intended that the claims cover all such modifications and alternative embodiments that fall within their scope.

The invention claimed is:

1. A mounting plate for holding a core carrying a wound roll, the mounting plate comprising:

a body having a wound roll facing surface that defines an inner plane (P);

a substantially cylindrical hub extending outwardly from the body beyond the inner plane (P) and terminating in a rim, the hub defining a hub axis (A); and at least one spacer affixed to the body and extending outwardly beyond the inner plane (P) but not as far as the rim, the spacer having a double hinged structure.

2. A mounting plate for holding a core carrying a web, the mounting plate comprising:

a body having a web facing surface that defines an inner plane (P);

a substantially cylindrical hub extending outwardly from the body and terminating in a rim, the hub defining a hub axis (A); and one or more spacers affixed to the body and extending outwardly beyond the inner plane but not as far as the rim; wherein each of the one or more spacers has a resiliently deformable structure; wherein:

each spacer comprises an inner member and a plurality of legs extending from the inner member, each leg being resiliently deformable between a first position in which the kg is uncompressed and the inner member is at an innermost position, and a second position in which each leg is are compressed and the inner member is located outwardly from its innermost position.

3. The mounting plate of claim 2 wherein:

each leg comprises a first panel extending outwardly from the inner member at an oblique included angle ($\alpha$).

4. The mounting plate of claim 2 wherein:

each leg comprises a first panel extending outwardly from the inner member at an oblique included angle and terminates along a first hinge line.

5. The mounting plate of claim 4 wherein:

each leg further comprises a second panel extending at an acute included angle inwardly from the first hinge line and terminates along a second hinge line.

6. The mounting plate of claim 5 wherein:

each leg further comprises a third panel extending outwardly at an angle from the second hinge line and terminates along the body.

7. The mounting plate of claim 6 wherein:

the third panel is affixed to the body along a third line.

8. The mounting plate of claim 2 wherein:

each spacer comprises an inner member and a pair of legs generally extending outwardly from the inner member and affixed to the body, wherein the inner member can move reciprocally in the direction of the hub axis (A).

9. The mounting plate of claim 8 wherein:

each leg comprises a first section and a second section, the first section extending outwardly from the inner member to a first inflection line, the second section extending outwardly from the first inflection line.

10. The mounting plate of claim 9 wherein:

the second section terminates at a second inflection line, the spacer further comprising a third section extending from the second inflection line and connected to the body.

11. The mounting plate of claim 10 wherein:

the third section is affixed to the body along a hinge line.

12. The mounting plate of claim 11 wherein:

the third section is U shaped and is located below the inner plane (P) of the body.

13. The mounting plate of claim 2 wherein:

each spacer is arcuate shaped and comprises two curved legs extending from opposite sides of a center apex to the body.

14. The mounting plate of claim 13 wherein:

each leg is affixed to the body along a hinged line.

15. The mounting plate of claim 2 wherein:

each spacer comprises an inner member mounted on one or more legs that are affixed to the body by convoluted bridges.

* * * * *